United States Patent [19]

Senghaas et al.

[11] Patent Number: 4,583,916

[45] Date of Patent: Apr. 22, 1986

[54] ELECTRICAL CONTROL SYSTEM FOR OIL WELL BAILER PUMP

[75] Inventors: Karl A. Senghaas; Peter Senghaas, both of San Antonio, Tex.

[73] Assignee: Southwest Bailer Pump Company, San Antonio, Tex.

[21] Appl. No.: 713,216

[22] Filed: Mar. 18, 1985

Related U.S. Application Data

[63] Continuation-in-part of Ser. No. 566,831, Dec. 29, 1983, Pat. No. 4,516,911.

[51] Int. Cl.[4] ..... F04B 49/00; F04B 17/00; E21B 27/00

[52] U.S. Cl. ..... 417/36; 417/410; 417/411; 166/53; 166/75.1; 166/168; 294/68.22

[58] Field of Search ..... 417/36, 410, 411, 415; 166/53, 72, 75 R, 168, 369; 294/68.22

[56] References Cited

U.S. PATENT DOCUMENTS

| | | | |
|---|---|---|---|
| 4,037,662 | 7/1977 | Bowling | 166/168 X |
| 4,062,640 | 12/1977 | Gault | 417/415 |
| 4,086,035 | 4/1978 | Klaeger et al. | 417/410 |
| 4,368,909 | 1/1983 | Alexander | 417/410 X |
| 4,476,418 | 10/1984 | Werner | 417/415 |
| 4,534,706 | 8/1985 | Palm et al. | 417/415 |

*Primary Examiner*—William L. Freeh
*Assistant Examiner*—Paul F. Neils
*Attorney, Agent, or Firm*—Fulbright & Jaworski

[57] ABSTRACT

A direct current operated bailer pump which utilizes battery power to winch up, while recovering the energy generated by the motor acting as a generator during the downward movement of the bailer to recharge the battery. A sensing circuit senses when the bailer contacts the surface of the oil by monitoring the generated voltage from the motor. A voltage drop corresponds to the sudden decrease in velocity as the bailer encounters the surface of the oil in the well. A dynamic brake is connected to the motor, after a set time period, to decrease the down speed of the bailer to a predetermined safe speed.

9 Claims, 5 Drawing Figures

ELECTRICAL CONTROL SYSTEM FOR OIL WELL BAILER PUMP

CROSS REFERENCE TO RELATED APPLICATION

This application is a continuation-in-part of U.S. patent application Ser. No. 06/566,831, filed Dec. 29, 1983, now U.S. Pat. No. 4,516,911, entitled Solid State Control System for Oil Well Bailer Pump.

BACKGROUND OF THE INVENTION

It is well known to utilize a bailer pump for oil wells. Such systems utilize a reversible electric motor for lowering a bailer on a cable into a well where it is filled, raised, emptied, and recycled. Such systems are useful for recovering oil from shallow low-yield wells.

However, such systems generally use a mechanical type of sensor for determining when the bailer is lowered and contacts the surface of the oil in the well for controlling part of the sequence of operation. Such sensors are subject to wear, and are subject to inadvertent actuation due to the irregularities in the motion of the bailer such as when the bailer moves down the well and encounters the sides of the well.

The present invention is directed to various improvements in an electrical control system for oil well bailer pumps (1) in which the weight of the bailer drives the motor in reverse rotation to generate a voltage for recharging a battery to recover energy to drive the motor to lift the bailer as well as limiting the down speed of the bailer, (2) an electrical sensing circuit monitors the generated voltage and determines the oil level in the well as a drop in voltage corresponds to a decrease in velocity as the bailer hits the surface of the oil, and (3) a dynamic brake reduces the fall velocity of the bailer prior to impacting the oil to decrease the down speed to a safe range.

SUMMARY

The present invention is directed to an electrical system for an oil well bailer pump having an electric motor for actuating a cable for lowering a bailer into an oil well, filling the bailer, raising the bailer, emptying the bailer, and recycling by providing electrical means for sensing the fluid level of the oil in the oil well. The electrical sensing means includes an electrical sensing circuit connected to the motor for monitoring the voltage generated by the motor as the motor is driven as a generator by the bailer as the bailer is lowered in the well and includes means for determining when the bailer contacts the oil in the well by sensing the drop in the generated voltage from the motor.

Still a further object of the present invention is the provision of a free fall winch down circuit for allowing the bailer to lower into the well and rotate the motor driving the motor as a generator with an electrical charging circuit connected between the motor and a battery for charging a battery from the voltage generated by the motor.

Yet a still further object of the present invention is the provision of a dynamic braking means which is connected, after a predetermined time period, across the motor for lowering the downward speed of the bailer.

Yet a still further object of the present invention is the provision of an electrical control system for an oil well bailer pump having a battery driven direct current electrical motor for actuating a cable for lowering a bailer into an oil well, filling the bailer, raising the bailer, emptying the bailer and recycling. The system includes a winch up circuit for actuating the motor to raise the bailer, an up overshoot circuit for opening the bailer for emptying oil therefrom, in which said overshoot circuit is actuated by the end of the winch up circuit. An up hold circuit is provided for directing the draining oil from the bailer and is actuated by the end of the overshoot circuit. A free fall winch down circuit is provided for lowering the bailer toward the surface of the oil in the well and is actuated in response to the up hold circuit. An electrical charging circuit is connected between the motor and the battery for charging the battery from the motor as the bailer is lowered and rotates the motor. A down overshoot circuit is provided for lowering the bailer a predetermined distance below the oil surface in the well for filling the bailer with oil and is actuated in response to the electrical charging circuit. A down hold circuit is provided for allowing time for the bailer to fill and is actuated by the end of the down overshoot circuit and in turn actuates the winch up circuit.

Other and further objects, features and advantages will be apparent from the following description of a presently preferred embodiment of the invention, given for the purpose of disclosure and taken in conjunction with the accompanying drawings where like character references designate like parts throughout the several views.

DESCRIPTION OF THE PREFERRED EMBODIMENTS

Figure 1:
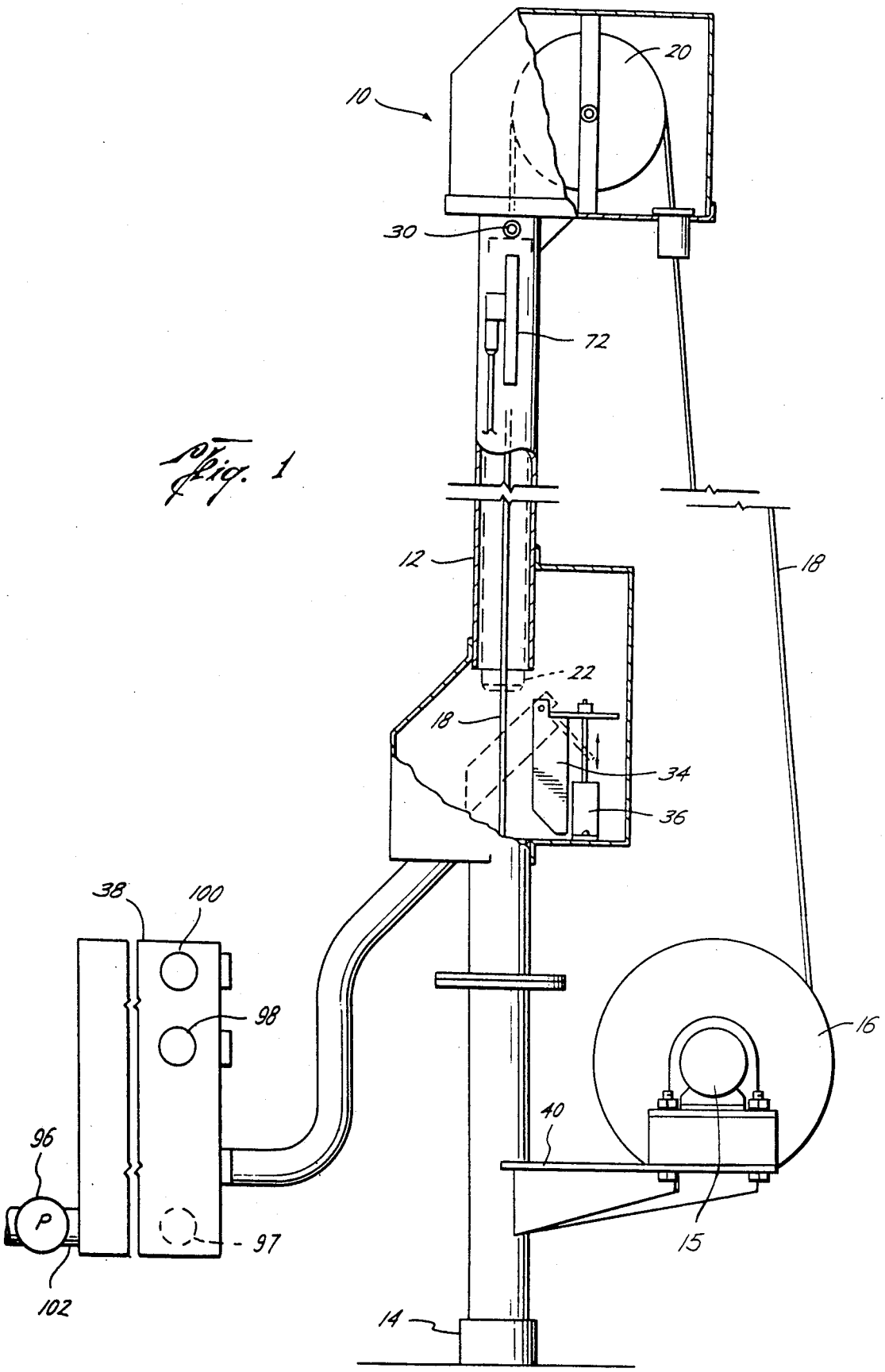
FIG. 1 is an elevational view, partly in cross section, illustrating one type of oil well bailer pump.
Figure 2:
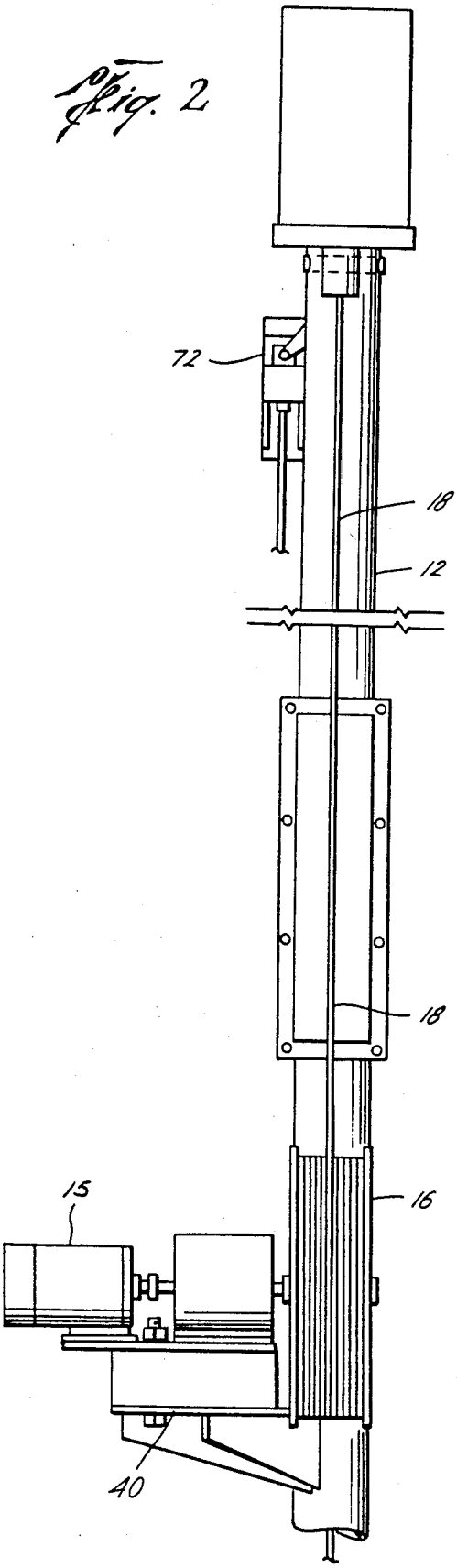
FIG. 2 is a side elevational view of the apparatus of FIG. 1.
Figure 3:
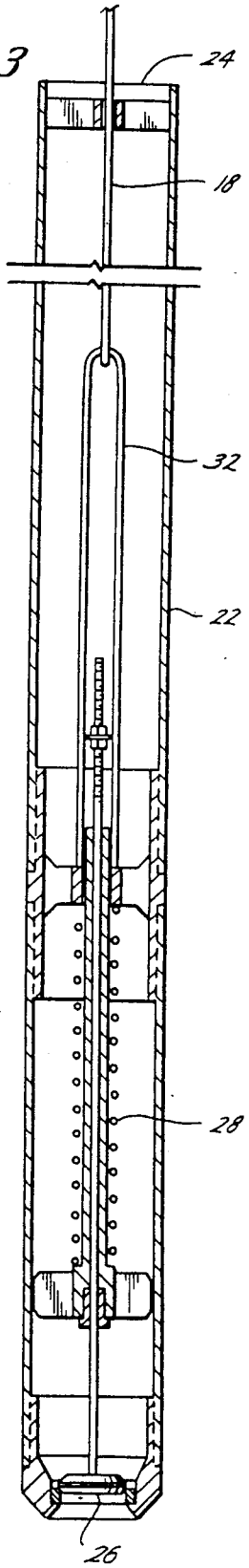
FIG. 3 is an enlarged cross-sectional view of a suitable type of bailer for use in the apparatus of FIGS. 1 and 2.

Referring now to the drawings, particularly to FIGS. 1, 2 and 3, an oil well bailer pump is generally indicated by the reference numeral 10 and includes a standpipe 12 connected to a wellhead 14, a motor 15 driving a winch 16 which reels in and releases a cable 18 carried over a pulley 20 and connected in the well to a bailer 22. The bailer 22 is lowered into the oil and the oil flows into the top 24 of the bailer 22 with the bottom being closed by a valve 26 which is normally held in the closed position by gravity. After filling, the motor 15 is actuated, winds up the cable 18 and lifts the bailer 22 to the top of the standpipe 12. The top of the bailer 22 engages a stop 30 and a further pull on the cable 18 pulls the slide 32 upwardly moving the valve element 26 off of its seat and opening the bottom of the bailer 22.

A dump pan 34 is energized by a solenoid 36 to move into the position indicated in the dotted outline (FIG. 1) to receive the oil which is dumped from the bailer 22 and diverts the oil into an oil holding tank 38. The dump 34 is then retracted out of the way and the cycle is repeated. Various types of oil well bailer pumps are disclosed in U.S. Pat. Nos. 4,037,662; 4,086,035; and 4,368,909.

However, prior art bailer pumps utilize various types of mechanical sensors such as limit switches or tiltable arms in order to detect when the bailer contacts the surface of the oil in the oil well. Such systems are less than satisfactory in that they were subject to wear and inadvertent actuation as the bailer contacts the side of the well in its downward movement.

The present invention is directed to a control system that can control and operate various types of bailer pumps including the pump described in FIGS. 1-3 which will automatically and electrically adjust the depth that the bailer is lowered to correspond to the actual oil level in the well while at the same time recovering energy during the lowering of the bailer.

Figure 5:
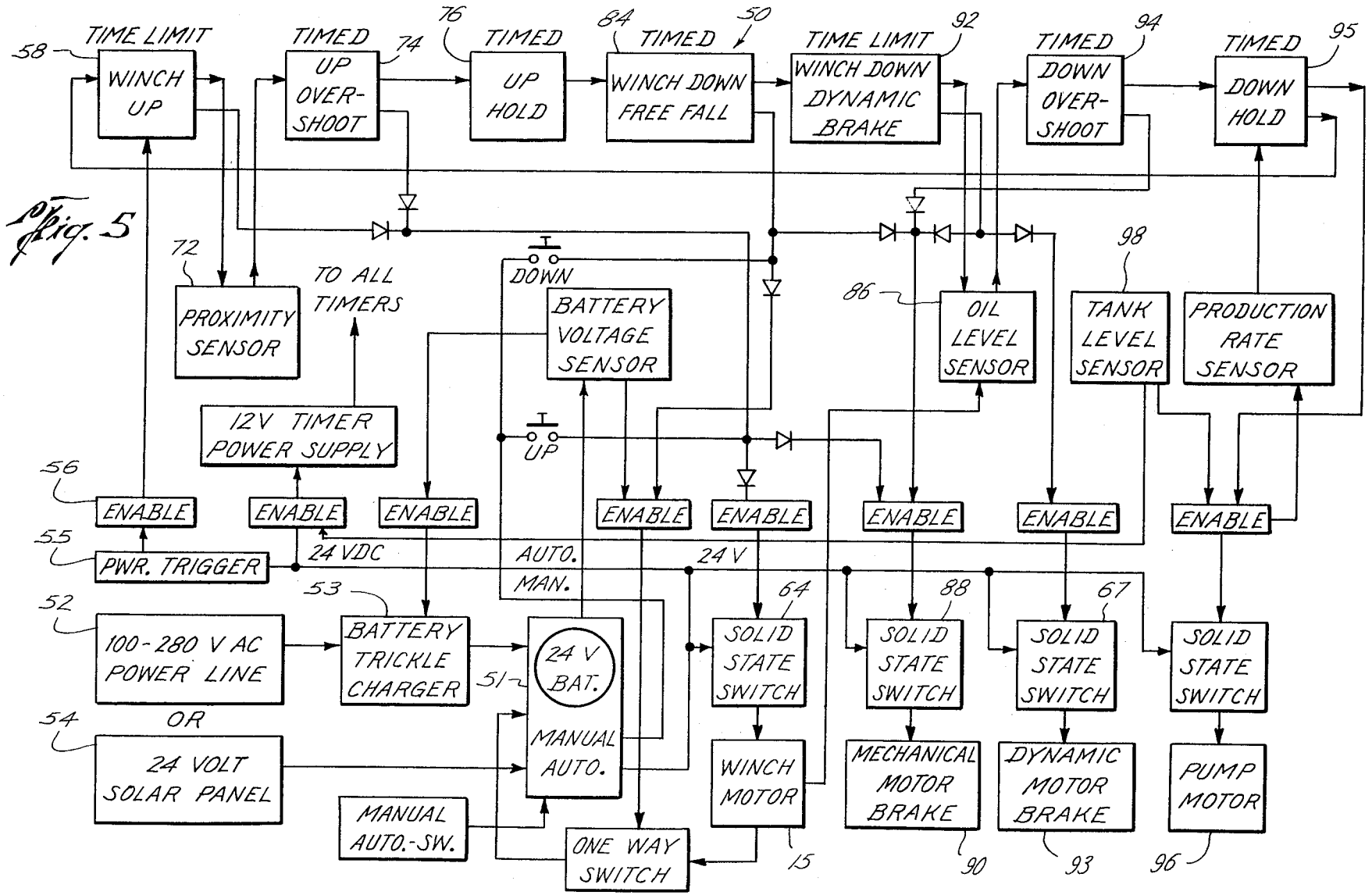
FIG. 5 is an electrical block diagram of the controller of the present invention.

Referring now to FIG. 5, the schematic of the present control system is generally indicated by the reference numeral 50 and includes a plurality of operations which sequentially actuate another operation and each of which is self-adjustable as to time to satisfy the operating requirements of any particular well. The system 10 provides a battery 51 for driving a direct current motor 15 whereby the power source is not subject to power line fluctuations and failures. The battery 51 may be charged by an alternating current power source 52 which powers a battery trickle charger 53 or, as an alternative, is powered by a solar panel 54. A power trigger 55, when energized, actuates an enable circuit 56 to start operation by starting a winch up circuit 58. The winch up circuit 58 actuates a switch 64 to actuate the winch motor 15 to raise the bailer 22 up the well. The winch up circuit 58 is controlled by an individually adjustable timer. The bailer is raised to the position of the proximity switch 72 which assures the positional accuracy of the bailer 22 for a proper draining position. With the use of the proximity switch 72 the timer to the winch up circuit 58 functions as a delayed safety shutoff. An up overshoot circuit 74 is actuated by either the winch up circuit 58 or the limit switch 72 and is also controlled by an adjustable timer. The up overshoot circuit 74 raises the bailer 22 into engagement with the stop 30 and thereafter opens the valve 26 (FIG. 3) to allow oil to drain from the bottom of the bailer 22. The up overshoot 74 actuates an up hold circuit 76. The up hold circuit 76 actuates the solenoid 36 (FIG. 1) to move the dump 34 into a position under the bailer 22 so that the released oil is drained to the holding tank 38.

At the conclusion of the up hold cycle 76, the free fall winch down circuit 84 is actuated. One of the features of the winch down free fall is to utilize the motor 15 to generate power while the bailer is being lowered in the well to recharge the battery 51. In addition, a sensing circuit 86 is provided which monitors the voltage generated by the winch motor 15 in its down mode and is designed to sense the oil level in the well since the output from the motor 14 will have a voltage drop corresponding with the sudden decrease in velocity of the bailer 22 as it impacts on the surface of the oil. During the free fall of the bailer 22, the winch down circuit 84 operates a switch 88 which deactuates the mechanical motor brake 90.

The voltage generated by the dc winch motor 15 when the bailer is moving downwardly is a function of its permanent magnet, rotor windings, and the motor rpm. However, in order to avoid damage to the winch components by excessive speed, a limit to the maximum free fall velocity is imposed by allowing the generated voltage to charge the battery at a predetermined rate. This not only avoids excessive speed, but conserves energy by allowing the motor to generate voltage to charge the battery 51 for the next cycle. However, the free fall period is set by the timer of the winch down circuit 84. At the end of the set time period, a winch down dynamic brake circuit 92 is actuated by the winch down free fall circuit 84. That is, it is desirable to have a reduction of the free fall velocity of the bailer 22 prior to impacting the oil surface in the well to avoid damage to the winch components. Therefore, a dynamic brake 93 such as an additional electric load is now placed across the winch motor 15 to decrease its speed a further amount.

In one embodiment, the bailer 22 was permitted to free fall by the winch down circuit 84 to within 100 feet of the average fluid table of the oil if the table varies considerably or to within 50 feet if the oil table is steady. At the end of the free fall, the dynamic brake cycle 92 is actuated and is used to the point at which the bailer impacts the oil surface. Thus, after lifting the brake 90, the motor 15 is forced into reverse rotation and acts as a generator and as its speed increases beyond its nominal rpm, such as 1720, it generates a voltage in excess of its nominal voltage of 24 volts. For example, the maximum free fall voltage generated is approximately 30 volts while the average voltage generated during the application of the dynamic brake is approximately 16 volts. It is estimated that the recovery of energy during the free fall will be from 40 to 60% which will significantly decrease the operational costs of the system.

As the bailer 22 hits the oil surface, its velocity will suddenly decrease and also the voltage generated by the motor 15 decreases. The sensing circuit 86 detects this drop in voltage and triggers the down overshoot circuit 94. It is to be particularly noted that the detection of the oil surface in the well is determined by the electrical sensing circuit 86 instead of with a mechanical sensor. The electrical sensor quickly and easily detects the oil surface, is not subject to wear as with a mechanical sensor, and is not affected by irregularities in the motion of the bailer.

The down overshoot circuit 94 allows the bailer 22 to drop a measured distance below the oil surface in the well and fill the bailer with oil by gravity. The end of the down overshoot circuit 94 actuates the down hold circuit 95 which is also controlled by an automatic timer to allow the bailer 22 to obtain a full load prior to the next winch up cycle 58. The settling tank 38 receives the oil dump from the bailer 22 and includes a tank level sensor 98 with a low float position 97 and an overflow float position 100. The float sensor 98 enables the pump 96 when the amount of oil in the settling tank 38 rises to its high position.

Figure 4:
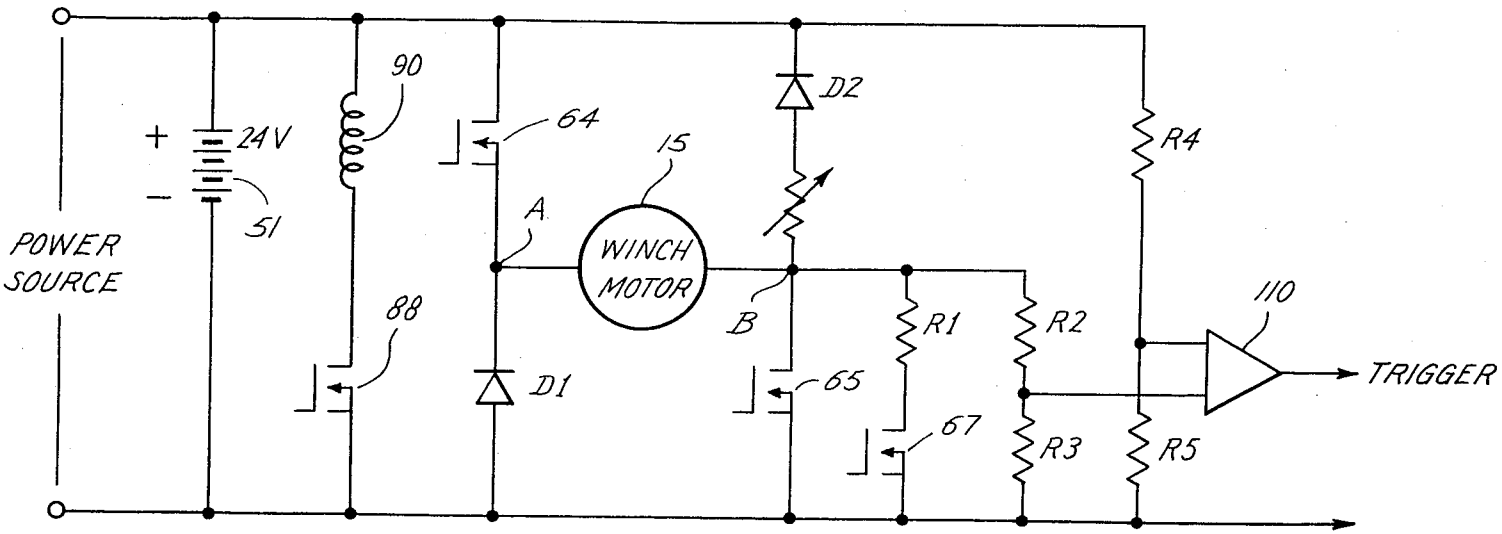
FIG. 4 is an electrical schematic diagram of the electrical charging circuit, sensing circuit and dynamic braking circuit.

Referring now to FIG. 4, a schematic is shown which illustrates the operation of the winch motor, its direct current drive, mechanical brake circuit, along with the dynamic brake, fluid level sensing, and the recovery of energy generated during the free fall. When the winch up circuit 58 is actuated, switches 88, 64 and 65 are energized and closed. The actuation of switch 88 energizes the mechanical motor brake 90 and releases the motor 15. Closure of switches 64 and 65 provide a current path from the battery 51 through switch 64, the winch motor 15, switch 65 to result in a winch up motion to raise the bailer 22.

During the actuation of the winch down free fall circuit 84, switch 88 is actuated again to lift the mechanical motor brake 90 and the motor 15 is pulled backward by the weight of the bailer 22 and line 18 and the motor generates a voltage to charge the battery 51. Thus, a current path flows from terminal B through diode D2 to the positive battery terminal, the negative battery terminal, diode D1 and into terminal A. There is also a current path from terminal B through resistor R2, resistor R3, diode D1 and to terminal A to present the generated voltage to one side of the comparator 110 of the oil level sensor 86. Current also flows from the battery 51 through resistors R4 and R5 to provide a reference voltage to the comparator 110.

When the winch down free fall circuit 84 times out and actuates the winch down dynamic brake circuit 92, switch 67 is energized and closed and attaches the dynamic motor brake 93 such as load resistor R1 across the motor 15 to slow the descent of the bailer 22. The brake current path is from terminal B through the load resistor R1, switch 67, diode D1 and terminal A to slow the descent of the bailer 22. Again, the generated voltage flows from a path from terminal B, through resistor R2, through resistor R3, diode D1 and to terminal A to the comparator 110.

When the bailer 22 impacts upon the oil surface in the well, the comparator 110 detects a drop in the generated voltage causing the oil level sensor circuit 86 to trigger the down overshoot circuit 94 and disenergize switch 67 and lets the bailer 22 sink into the oil.

The electrical control system of the present invention provides all solid state circuits which are not subject to mechanical wear and/or frequent adjustments, increase reliability over mechanical tilt or tension switch devices, and is not affected by irregularities in the bailer motion in sensing the level of the oil in the well. Furthermore, the present invention recovers energy generated during the free fall of the bailer down the well to recharge the battery thereby conserving energy and at the same time limiting the rate of the free fall velocity to a safe speed. In addition, a dynamic brake is provided to further reduce the free fall velocity before the bailer impacts the oil level in the well to avoid damage to the winch components.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts may be made which will readily suggest themselves to those skilled in the art and which are encompassed within the spirit of the invention and the scope of the appended claims.

What is claimed is:

1. In an electric control system for an oil well bailer pump having an electric motor for actuating a cable for lowering a bailer into an oil well, filling the bailer, raising the bailer, emptying the bailer, and recycling, the improvement in means sensing the fluid level of the oil in the oil well comprising, a sensing circuit connected to the motor for monitoring the voltage generated by the motor as the motor is driven as a generator as the bailer is lowered into well, and means for determining when the bailer contacts the oil in the well by sensing the drop in the generated voltage from the motor.

2. In an electrical control system for an oil well bailer pump having a battery supplied direct current electric motor for actuating a cable for lowering a bailer into an oil well, filling the bailer, raising the bailer, emptying the bailer, and recycling, the improvement in lowering the bailer into the well comprising, a free fall winch down circuit for allowing the bailer to lower into the well and rotate the motor driving the motor as a generator, electrical charging circuit connected between the motor and the battery for charging the battery from the voltage generated by the motor, and a dynamic braking circuit connected, after a predetermined time period, across the motor for lowering the downward speed of the bailer.

3. The apparatus of claim 2 including, a sensing circuit connected to the motor for monitoring the voltage generated by the motor as the bailer is lowered for determining when the bailer reaches the surface of the oil in the well.

4. An electrical control system for an oil well bailer pump having a direct current electric motor for actuating a cable for lowering a bailer into an oil well, filling the bailer, raising the bailer, emptying the bailer, and recycling comprising, a winch up circuit for actuating the motor to raise the bailer, an up overshoot circuit for opening the bailer for emptying oil therefrom, said overshoot circuit actuated by the end of the winch up circuit, an up hold circuit for directing the draining oil from the bailer and actuated by the end of the overshoot circuit, a free fall winch down circuit for lowering the bailer towards the surface of the oil in the well, said winch down circuit actuated in response to the up hold circuit, a sensing circuit connected to the motor for measuring the voltage generated by the motor as the bailer is lowered for determining when the bailer reaches the surface of the oil in a well, a down overshoot circuit for lowering the bailer a predetermined distance below the oil surface in the well for filling said bailer with oil, said down overshoot circuit actuated in response to the sensing circuit, and a downhold circuit for allowing time for the bailer to fill, said down hold circuit actuated by the end of the down overshoot circuit, said down hold circuit actuating the winch up circuit.

5. An electrical control system for an oil well bailer pump having a battery driven direct current electric motor for actuating a cable for lowering a bailer into an oil well, filling the bailer, raising the bailer, emptying the bailer, and recycling comprising, a winch up circuit for actuating the motor to raise the bailer, an up overshoot circuit for opening the bailer for emptying oil therefrom, said overshoot circuit actuated by the end of the winch up circuit, an up hold circuit for directing the draining oil from the bailer and actuated by the end of the overshoot circuit, a free fall winch down circuit for lowering the bailer towards the surface of the oil in the well, said winch down circuit actuated in response to the up hold circuit, electrical charging circuit connected between the motor and the battery for charging the battery from the motor as the bailer is lowered and rotates the motor, a down overshoot circuit for lowering the bailer a predetermined distance below the oil surface in the well for filling said bailer with oil, said down overshoot circuit actuated in response to the electrical charging circuit, and a down hold circuit for allowing time for the bailer to fill, said down hold circuit actuating the winch up circuit.

6. The apparatus of claim 5 including, a sensing circuit connected to the motor for monitoring the voltage generated by the motor as the bailer is lowered for determining when the bailer reaches the surface of the oil in the well.

7. The apparatus of claim 1 including, a dynamic braking circuit connected across said motor for reducing the lowering speed of the bailer.

8. The apparatus of claim 7 wherein the braking circuit includes switching means and a load resistor.

9. The apparatus of claim 7 including, a sensing circuit connected to the motor for monitoring the voltage generated by the motor as the bailer is lowered for determining when the bailer reaches the surface of the oil in the well.

* * * * *